United States Patent [19]

Newman et al.

[11] Patent Number: 4,964,823

[45] Date of Patent: Oct. 23, 1990

[54] STERN DRIVE LIFT AND TRIM SYSTEM

[75] Inventors: Neil A. Newman, Omro; Herbert A. Bankstahl; John M. Griffiths, both of Fond du Lac; Lyle M. Forsgren, Oshkosh; Wayne T. Beck, Fond du Lac, all of Wis.

[73] Assignee: Brunswick Corporation, Skokie, Ill.

[21] Appl. No.: 303,568

[22] Filed: Jan. 27, 1989

[51] Int. Cl.[5] ..... B63H 5/12

[52] U.S. Cl. ..... 440/61; 440/53

[58] Field of Search ..... 440/53, 57, 58, 59, 440/60, 61, 62, 63, 75

[56] References Cited

U.S. PATENT DOCUMENTS

| | | | |
|---|---|---|---|
| 176,541 | 4/1876 | McKaig et al. | 440/62 |
| 1,735,660 | 11/1929 | Svendsen et al. | 440/62 |
| 2,809,605 | 10/1957 | Russell | 440/75 |
| 3,306,246 | 2/1967 | Reder | 440/59 |
| 3,357,393 | 12/1967 | Urbassik | 440/62 |
| 3,534,703 | 10/1970 | Ekman | 440/50 |
| 3,901,177 | 8/1975 | Scott | 440/61 |

FOREIGN PATENT DOCUMENTS

| | | | |
|---|---|---|---|
| 2224626 | 12/1972 | Fed. Rep. of Germany | 440/61 |
| 83694 | 6/1980 | Japan | 440/60 |

*Primary Examiner*—Sherman Basinger
*Assistant Examiner*—Thomas J. Brahan
*Attorney, Agent, or Firm*—Andrus, Sceales, Starke & Sawall

[57] ABSTRACT

A marine stern drive unit is mounted aft of the boat transom on a rigid lift arm in a manner allowing the drive unit to be independently trimmed or moved vertically up or down. The drive unit is pivotally attached to the aft end of the lift arm for trimming movement about a generally horizontal axis and the lift arm is pivotally attached to the boat to rotate about a second horizontal axis such that the drive unit is moved generally vertically. The boat engine is preferably mounted transversely and power transmission from the engine to the drive unit is provided by a flexible drive belt which is supported by the rigid lift arm. Separate trim and lift movement is supplied to the drive unit by individual fluid cylinders. The trim cylinder operatively interconnects the drive unit with the boat hull or the forward end of the lift arm. The lift cylinder operatively interconnects the boat hull and the lift arm at a point aft of its pivotal connection to the boat.

10 Claims, 4 Drawing Sheets

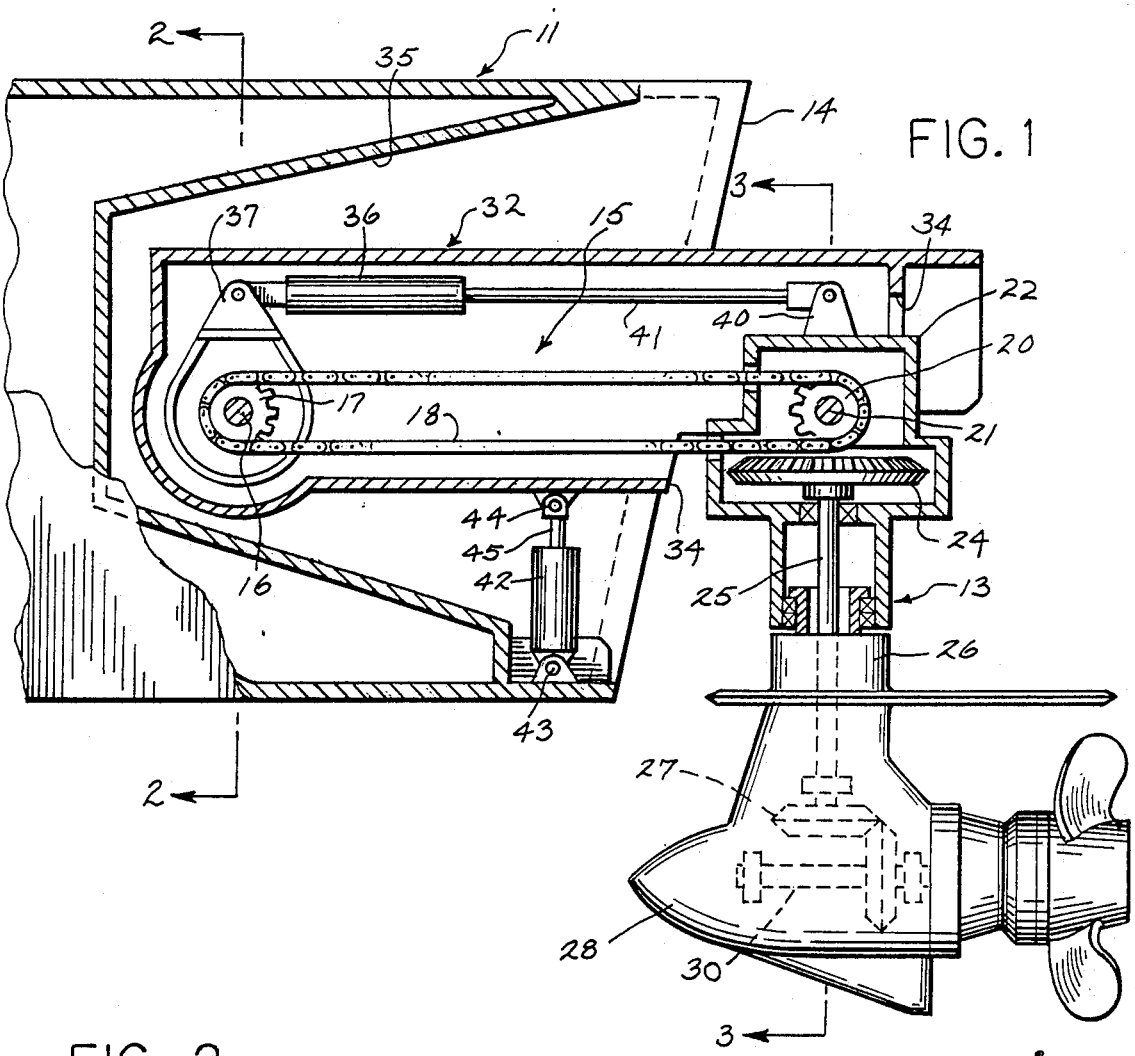
FIG. 1
FIG. 2
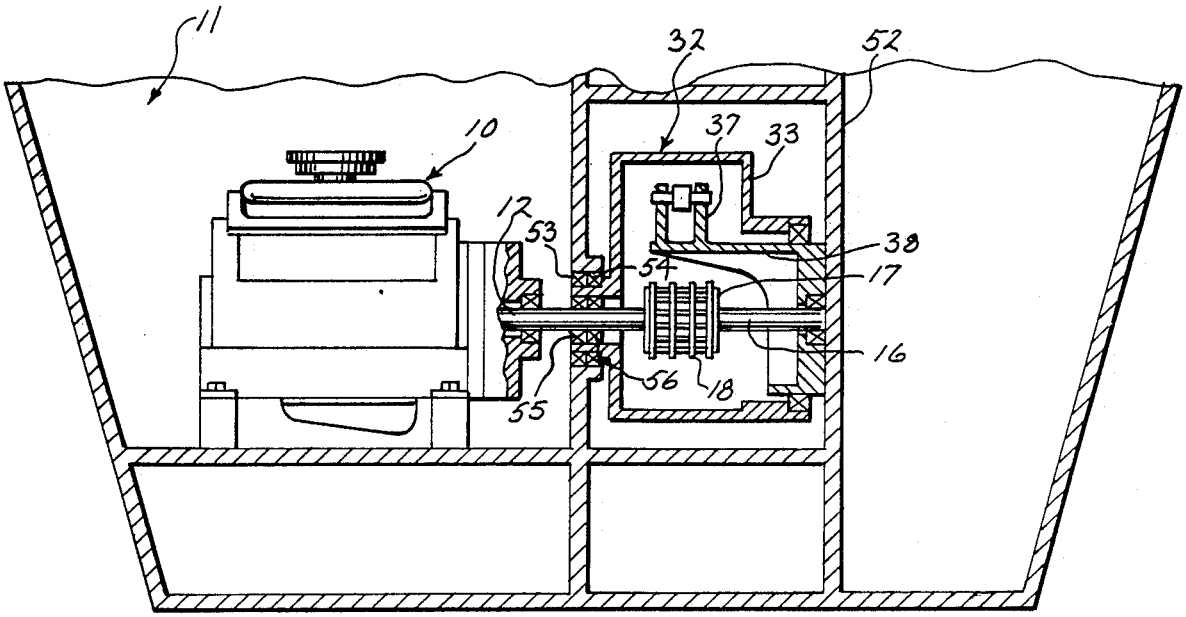

STERN DRIVE LIFT AND TRIM SYSTEM

BACKGROUND OF THE INVENTION

The present invention relates to a marine stern drive apparatus in which the engine is mounted within the boat and the drive unit mounted outside the boat. More particularly, the invention is directed to an improved system for selectively adjusting the lift and trim of the drive unit with respect to the boat transom.

Marine propulsion devices, including both outboard motors and stern drives, are typically supported from the boat transom by a drive mounting assembly. Various types of drive mounting assemblies are known, as for example a transom bracket used to mount an outboard motor directly on the boat transom or a gimbal ring assembly for mounting a stern drive unit directly to the transom. Typically, a drive unit mounted directly on a transom may be trimmed by pivoting it about a generally horizontal axis to position the propeller to optimize thrust with respect to the plane of the boat. However, the vertical position of the drive unit cannot typically be changed beyond the somewhat limited amount which results from the trimming operation. Therefore, the drive unit is generally mounted in a compromise position at an essentially fixed height which will provide the best overall performance.

Drive mounting assemblies have been developed which allow an outboard motor to be mounted aft of the boat transom in a manner which permits the motor to be either raised or lowered vertically with respect to the transom, as well as trimmed or tilted about a horizontal axis. Many of these transom extension types of outboard motor mounting assemblies are of a general type which includes a pivotally cited quadrilateral linkage. Such transom extension mounting assemblies have become increasingly popular on high performance boats where a lower motor position improves initial boat acceleration and a higher motor position enhances top speed by reducing gear case drag. Additionally, movement of an outboard motor vertically to a higher position reduces draft, thereby enhancing shallow water operation. It is also known that extending the mounting of an outboard motor aft of the transom improves the handling characteristics of many boats at high speeds.

U.S. Pat. No. 4,757,971 and U.S. patent applications Ser. No. 100,261, filed Sept. 23, 1987; Ser. No. 103,508, filed Oct. 1, 1987; and Ser. No. 181,685, filed Apr. 14, 1988, all of which are assigned to the assignee of this application, disclose outboard motor transom extension assemblies which utilize a quadrilateral linkage arrangement to raise and lower the motor with respect to the transom. The quadrilateral linkage comprises four pivotally connected links forming a collapsible linkage the movement of which effects vertical movement of the motor. If the collapsible linkage includes oppositely disposed links of equal length, collapse or opening of the linkage will cause a purely vertical movement of the motor. On the other hand, if either opposite pair of links are of unequal length, pivotal trimming or tilting movement of the motor will occur simultaneously with the vertical upward or downward movement.

In a marine stern drive unit, the engine is mounted inside the boat and the drive unit is attached to the outside of the transom. A fixed position drive shaft assembly interconnects the engine and the drive unit and provides for the transmission of power from the former to the latter. U.S. patent application Ser. No. 181,515, entitled "Variable Height Marine Propulsion Mechanism," filed Apr. 14, 1988, and assigned to the assignee of this application, discloses a transom mounted stern drive unit in which the position of the propeller may be adjusted vertically with respect to the transom. The apparatus allows the drive shaft to be maintained in a fixed position between the engine and the drive unit, but requires, as a result, a somewhat complex mechanical linkage to move the lower propeller unit vertically within the drive unit housing. U.S. patent application Ser. No. 241,615, entitled "Marine Propulsion System," filed Sept. 8, 1988, and also assigned to the assignee of this application, discloses a stern drive propulsion system including a transversely mounted engine and means for transferring power from the engine to the drive unit to accommodate vibrational engine movement and isolate the drive unit from the effects of such movement. The preferred embodiment of the power transmission means is a chain or belt drive from a horizontal engine crankshaft extension to a horizontal jackshaft in the drive unit. The drive unit is adapted to be pivoted about the jackshaft for trimming, but direct vertical movement of the drive unit is precluded.

SUMMARY OF THE INVENTION

The present invention provides an apparatus for mounting and driving a stern drive unit in a manner allowing the drive unit to be independently trimmed or moved vertically utilizing conventional power trim and power lift devices.

The system of the present invention for separately and selectively adjusting the lift and trim positions of the drive unit includes a rigid lift arm which supports the power transmission linkage between the engine mounted within the boat and the stern drive unit disposed aft of the boat transom. The rigid lift arm supports the drive unit for generally vertical movement with respect to the transom. The drive unit is also mounted to the lift arm for relative rotational trimming movement. A power lift means interconnects the boat and the lift arm to provide a generally vertical lifting movement to the lift arm and attached drive unit. A separate power trim means interconnects the boat and the drive unit for providing the rotational trimming movement thereto.

In the preferred embodiment, the engine is mounted within the boat with its crankshaft disposed transversely with respect to the boat centerline and the power transmission means comprises a sprocket-drive belt. The drive and driven sprockets are attached to a crankshaft extension and a driven shaft in the drive unit, respectively. The rigid lift arm which supports the drive belt is pivotally attached to the stern of the boat for rotation about the axis of the engine crankshaft. The power lift and trim means preferably comprise separate fluid cylinders.

In one embodiment, the trim cylinder may be disposed with respect to the lift arm and power transmission belt to establish a parallelogram linkage such that vertical movement of the drive unit under the influence of the lift cylinder results in no pivotal trimming movement of the drive unit. Optionally, the trim cylinder may be adjusted to provide a combined lift and trim movement to the drive unit under the influence of the lift cylinder alone. Finally, each of the trim and lift cylinders may be operated simultaneously or in succession to provide any desired combination of lift and trim within the limits of the system.

BRIEF DESCRIPTION OF THE DRAWINGS

FIG. 1 is a side elevation, partly in section, showing a schematic representation of the system of the present invention.

FIG. 2 is a vertical transverse section taken on line 2—2 of FIG. 1.

DETAILED DESCRIPTION OF THE PREFERRED EMBODIMENT

Figure 3:
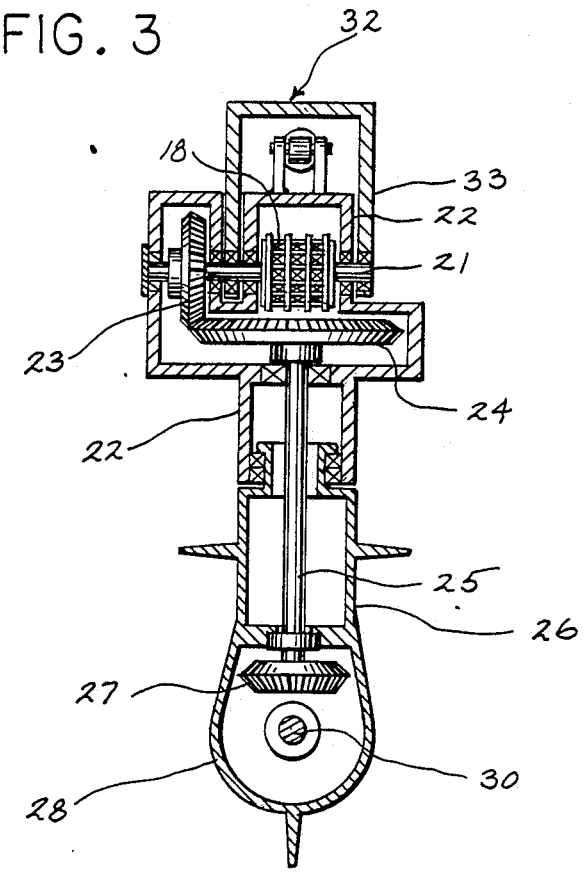
FIG. 3 is a vertical section through the drive unit taken on line 3—3 of FIG. 1.

Referring particularly to FIGS. 1-3, an internal combustion engine 10 is mounted to the hull of a boat 11 with the crankshaft 12 of the engine disposed transversely with respect to the longitudinal center line of the boat. Driving power from the engine 10 is transmitted to a drive unit 13 disposed aft of the transom 14 of the boat 11. A power transmission linkage 15 interconnects the engine and the drive unit and transmits driving power from the former to the latter.

A crankshaft extension 16 is journaled for rotation with the crankshaft 12. A drive sprocket 17 is mounted on the crankshaft extension for rotation therewith. The drive sprocket 17 preferably has a multi-sprocket configuration adapted to accommodate a multi-strand drive chain 18. Drive chain 18 extends aft from its connection to the drive sprocket 17 for engagement with a driven sprocket 20 of a construction similar to the drive sprocket 17. Driven sprocket 20 is mounted for rotation on a short horizontally disposed driven shaft 21 journaled for rotation in an upper housing 22 of the drive unit 13. A beveled drive gear 23 is attached to one end of the driven shaft 21 for rotation therewith and is positioned to engage a beveled driven gear 24 disposed below and perpendicular to the drive gear. The driven gear 24 is mounted on the upper end of a vertically disposed main driveshaft 25 which extends downwardly through the upper housing 22 and into the lower housing 26 of the drive unit where, via a conventional gearing arrangement 27 in a lower gear case 28, driving connection with a propeller shaft 30 and propeller 31 is effected. The lower housing 26 and gear case 28 are rotatable about the axis of the main driveshaft 25 with respect to the upper housing 22 for steering. The specific steering control means is, however, not shown.

The power transmission linkage 15 is housed within a rigid lift arm 32 which is mounted at its forward end for rotation about the axis of the crankshaft extension 16 and relative vertical movement with respect to the transom 14 of the boat. The lift arm 32 includes a generally box-like housing 33 which includes an opening 34 in its aft end to receive a portion of the upper end of the upper housing 22. The short horizontal driveshaft 21 extends through and is journaled for rotation within the side walls of the housing 33 for the lift arm 32. Thus, the drive unit 13 may pivot with respect to the lift arm 32 about the axis of the driveshaft 21 and within the limits of the opening 34 in the lift arm housing 33. This pivotal movement provides the trimming movement for the drive unit utilized to optimize the position of the propeller with respect to the plane of the boat.

In the embodiment shown, the lift arm 32 is disposed partially within a recess 35 in the boat transom 14 and extends aft of the transom to support the drive unit 13 in a position also spaced aft of the transom.

A trim cylinder 36 is disposed within the lift arm housing 33 above and substantially parallel to the drive chain 18. The forward end of the trim cylinder 36 is rotatably pinned to a forward clevis 37 which forms an integral part of an anchor bracket 38. Anchor bracket 38 is attached to the boat hull in a manner generally surrounding and coaxial with the crankshaft extension 16 with the forward clevis 37 disposed vertically above the drive sprocket 17. The opposite end of the trim cylinder 36 is rotatably pinned to an aft clevis 40 attached to the upper housing 22 of the drive unit directly above the driven sprocket 20. With the forward end of the trim cylinder 36 attached to the fixed anchor bracket 38, extension or retraction of the trim cylinder rod 41 causes the drive unit to be pivoted about driven shaft 21 with respect to the lift arm 32 and the boat.

A lift cylinder 42 is disposed within the recess 35 in the transom and below the lift arm 32. One end of the lift cylinder is rotatably pinned to a lower clevis 43 attached to the lower portion of the boat hull. The other end of the lift cylinder 42 is rotatably pinned to an upper clevis 44 attached to the underside of the lift arm housing 33. Extension or retraction of the lift cylinder rod 45 will cause the lift arm 32 to rotate in its journaled connection about the axis of the crankshaft extension 16. Such rotation will cause the drive unit 13 attached to the aft end of the lift arm to move vertically in an upward or downward direction.

Trim and lift cylinders 36 and 42, respectively, may be operated with conventional pneumatic or hydraulic controls to work independently or in unison and thereby provide separate trimming or lifting movement or a combination of simultaneous trim and lift. Referring particularly to FIG. 1, the trim cylinder 36 is positioned such that the distance between the forward and aft clevises 37 and 40, respectively, is equal to the distance between the axes of the crankshaft extension 16 and the driven shaft 21. If the pinned connections of the trim cylinder to the forward clevis 37 and the aft clevis 40 are equidistant from the axes of the crankshaft extension 16 and the driveshaft 21, respectively, the various pivotal connections will constitute a parallelogram linkage, such that extension or retraction of the lift cylinder rod 45 will result in direct vertical movement of the drive unit 13 with no pivotal movement relative to the vertical (although the drive unit will, of course, rotate about driven shaft 21 with respect to the lift arm 32). If the length of the trim cylinder 36 is varied in either direction by extending or retracting the cylinder rod 41, the linkage will no longer form a true parallelogram and subsequent vertical lift movement of the lift arm 32 by extending or retracting the lift cylinder 42 will result in a simultaneous trimming movement of the drive unit. Obviously, simultaneous operation of trim cylinder 36 and lift cylinder 42 in either direction can result in various patterns of simultaneous trim and lift movement of the drive unit. A more detailed description of the construction and operation of a quadrilateral linkage mechanism is contained in U.S. application Ser. No. 180,685, identified above. The lift end trim mechanism disclosed in that application is utilized with an outboard motor and the mechanism of the present invention provides the attributes of the outboard motor system to a stern drive unit.

Figure 4:
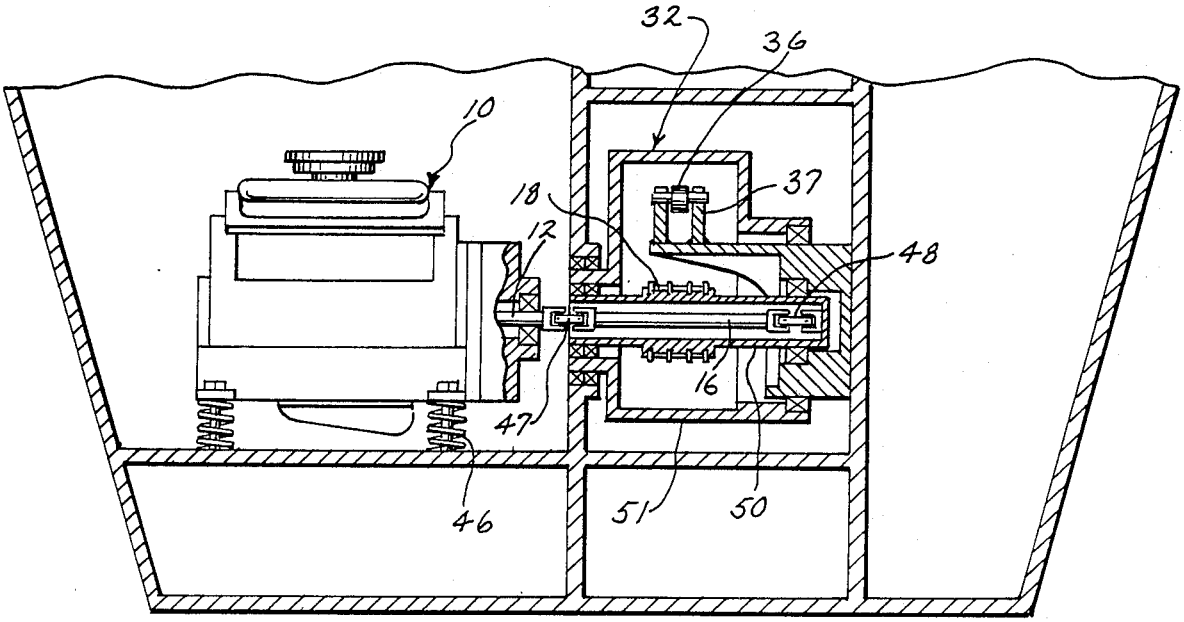
FIG. 4 is a vertical transverse section similar to FIG. 2, showing an alternate embodiment for attaching the drive sprocket to the engine.

FIG. 4 shows an alternate arrangement for the attachment of the crankshaft extension 16 to the engine and the attachment of the drive sprocket to the crankshaft extension. In this embodiment, the engine 10 is attached to the boat hull with softer engine mounts 46 to reduce the transmission of engine vibrations to the hull. However, to eliminate or minimize the transmission of engine vibrations through the power transmission apparatus to the drive unit, a modified crankshaft to drive sprocket arrangement is provided. The crankshaft extension 16 is attached at one end to the engine crankshaft by a U-joint 47. The opposite end of the crankshaft extension is attached to the bottom of a cylindrical torque tube 50 with a U-joint 48. The torque tube 50 is disposed axially around the crankshaft extension and substantially encloses it. The torque tube is journaled for rotation with the crankshaft extension and carries an integral drive sprocket 51 to which a drive chain 18 is attached in a manner similar to the embodiment of FIGS. 1-3. The torque tube 50 allows the crankshaft extension to be long enough to dissipate the engine vibrations, but brings the drive sprocket 51 back to a position reasonably close to the centerline of the boat. A more detailed description of this variation is contained in U.S. patent application entitled "Marine Propulsion System," identified above.

In lieu of a drive chain 18, a reinforced elastomer cog belt of a type well-known in the art may be used. The drive and driven sprockets 17 and 20, respectively, would have to be suitably modified to accept the cog belt.

The trim cylinder 36, as previously indicated, may be held by suitable hydraulic control at a fixed length to function as a rigid leg in a four bar linkage while the lift cylinder 42 is operated to provide vertical movement to the drive unit. The trim cylinder may also be used as a shock absorber to, for example, permit upward pivotal movement of the drive unit 13 should it encounter and underwater obstruction.

Programmed operation of the hydraulic control system for the trim and lift cylinders may also be provided. Such control means may be utilized to coordinate the movement of the drive unit provided by each of the cylinders and microprocessor control may be employed to optimize drive unit positioning for various operating conditions or to automatically position the drive unit in any of a number of pre-established and selected positions. One such system, for example, is described in pending U.S. patent application entitled "Operation Optimizing System for a Marine Drive Unit", filed Aug. 24, 1988, and assigned to the assignee of this application.

Provision must be made to seal the engine compartment from the ingress of water through the side wall 52 of the recess 35 within which the lift arm is mounted. Thus, the bearing 53 by which the lift arm 32 is journaled for rotation with respect to the boat hull includes a rotating seal 54. Because water may also find its way into the opening 34 in the lift arm housing 33, the crankshaft extension bearing 55 should also include an appropriate seal 56.

Figure 5:
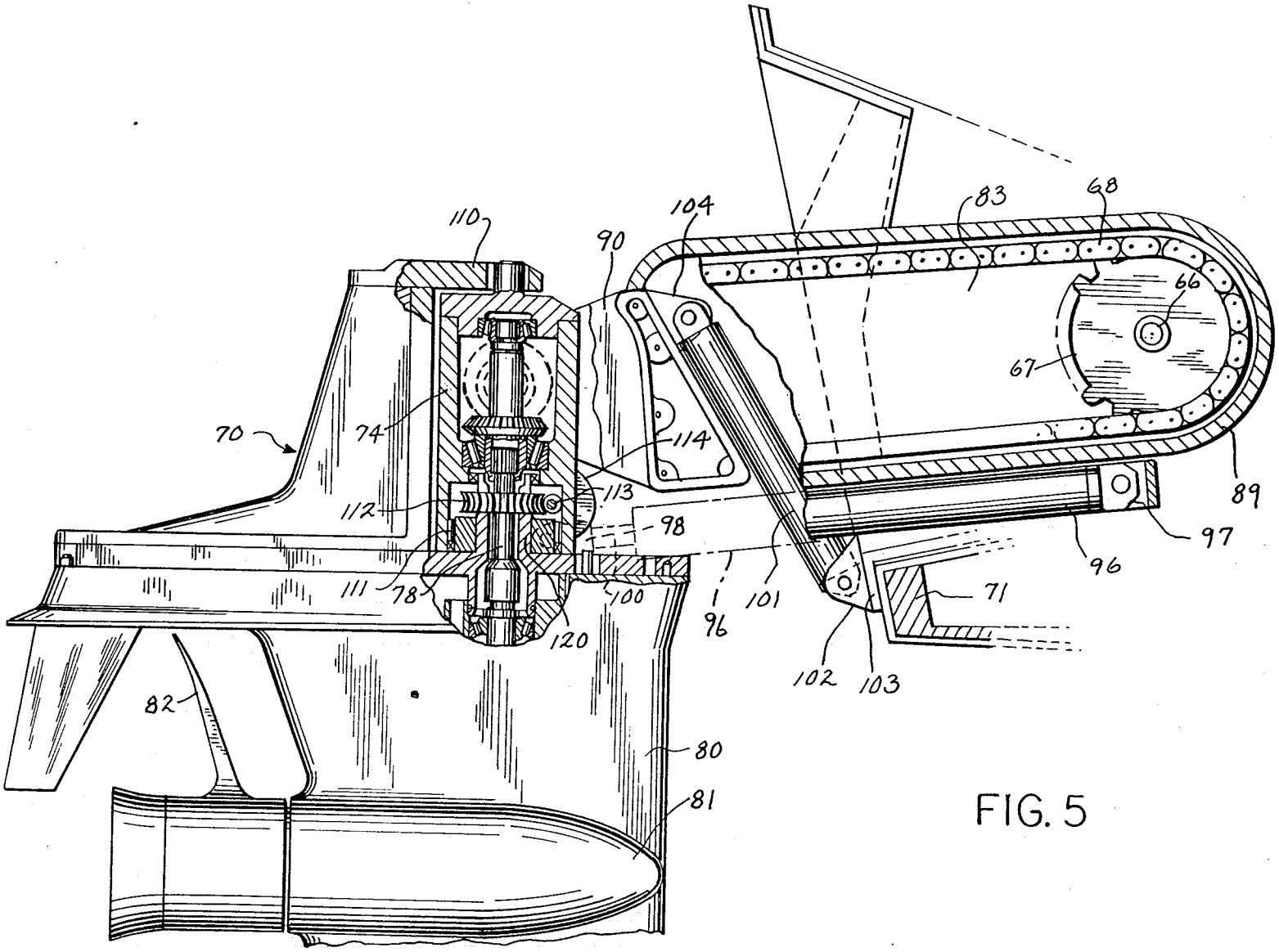
FIG. 5 is a side elevation, partly in section, showing a preferred embodiment of the invention.
Figure 6:
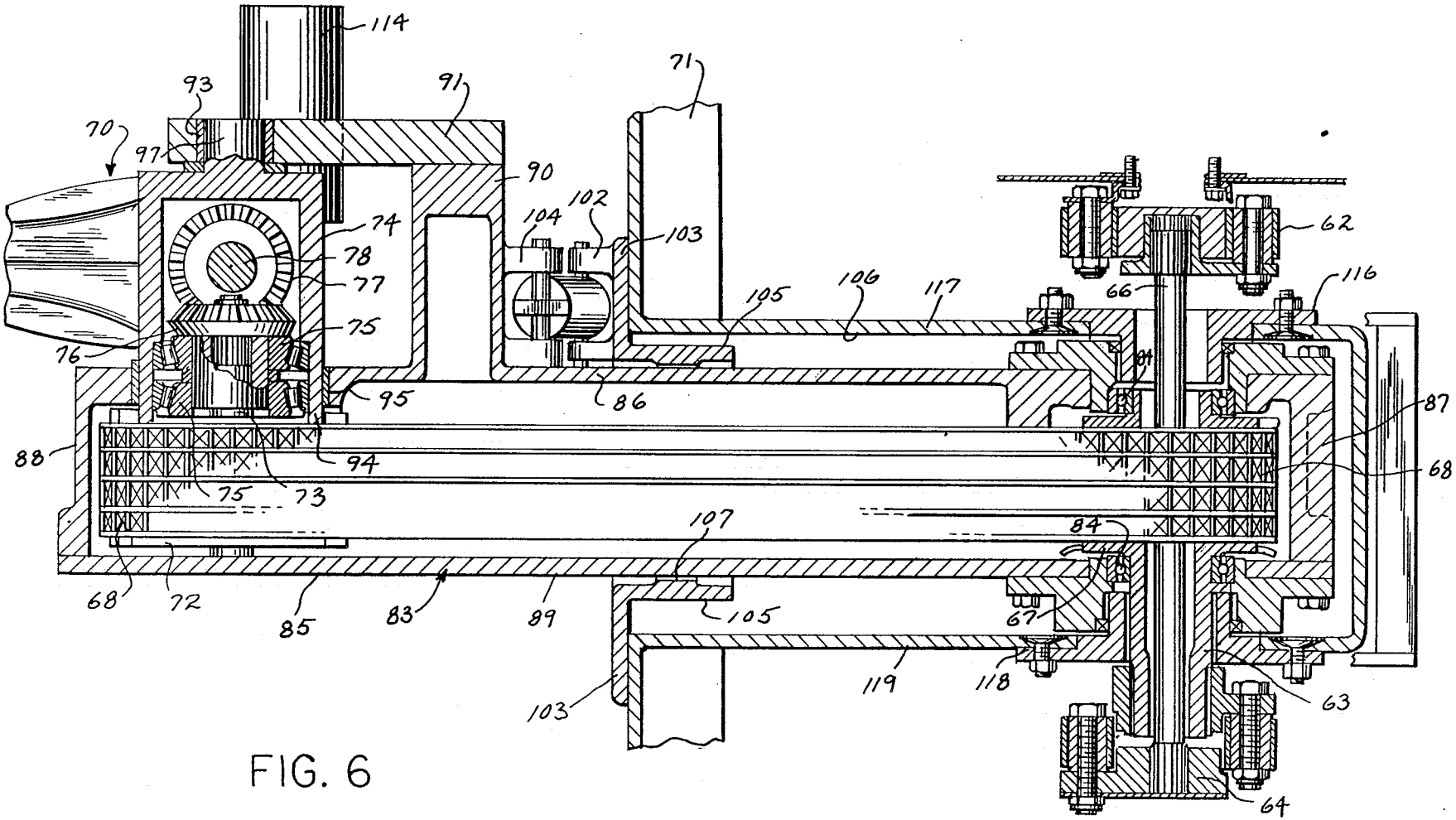
FIG. 6 is a top plan view of a generally horizontal section through the system shown in FIG. 5.

FIGS. 5 and 6 show a presently preferred embodiment of the system of the present invention. This embodiment utilizes a driving connection between the engine and the belt drive similar to that shown in FIG. 4.

A crankshaft extension 66 is rotatably attached to the engine flywheel via a first flexible coupling 62. The crankshaft extension 66 extends through a torque tube 63 where it is rotatably mounted to the opposite end thereof by a second flexible coupling 64. Flexible couplings 62 and 64 function in a manner similar to the U-joints 47 and 48 of the FIG. 4 embodiment. The torque tube 63 is journaled for rotation with the crankshaft extension 66 and carries an integral drive sprocket 67. A multi-strand drive chain 68 is engaged by the drive sprocket 67 to transmit driving power to a drive unit 70 mounted aft of the boat transom 71.

The drive chain 68 extends rearwardly to the drive unit where it engages a driven sprocket 72 mounted for rotation on a driven shaft 73. Driven shaft 73, in turn, is journaled for rotation in an upper housing 74 of the drive unit 70, as with bearings 75. One end of driven shaft 73 carries a beveled drive gear 76 adapted to engage a beveled driven gear 77. Driven gear 77 is attached to a vertically disposed main drive shaft 78 adapted to transmit power through a lower housing 80 to a lower gear case 81 to drive a propeller 82. A rigid lift arm 83 extends between and is journaled for rotation about the axis of the crankshaft extension 66 and the driven shaft 73. More particularly, the forward end of the lift arm 83 is rotatably mounted to the side walls 117 and 119 of recess portion 106 in the transom via bearing members 116 and 118, respectively.

Lift arm 83 comprises a generally box-like construction including side walls 85 and 86 and forward and aft end walls 87 and 88, respectively. An integral mounting bracket 90 extends laterally from the side wall 86 of the lift arm and has attached thereto a bracket arm 91 to which one side of the upper housing 74 of the drive unit is journaled for rotation via a trunnion 92 mounted in a journal bearing 93. The other side of the upper housing 74 includes an integral cylindrical sleeve 94 which is journaled for rotation within the side wall 86 of the lift arm by a journal bearing 95. In this manner, the drive unit 70 may rotate with respect to the lift arm 83 about the horizontal axis of the driven shaft 73.

Relative rotational trimming movement of the drive unit 70 with respect to the lift arm 83 about the axis of the driven shaft 73 is provided by a trim cylinder 96. Trim cylinder 96 is disposed directly below the lift arm housing 89 and extends generally parallel thereto. The trim cylinder may be mounted either inside or outside the lift arm housing 89. Thus, the forward end of the trim cylinder 96 is rotatably mounted to a forward clevis 97 which, in turn, may be attached to a side wall 85 or 86 of the lift arm housing or directly to the hull of the boat, as in the FIG. 1 embodiment.

The aft end of the trim cylinder 96 is rotatably attached to an aft clevis 98 integrally attached to the lower end of the upper drive unit housing 74. Extension or retraction of the cylinder rod 100 of the trim cylinder will result in the indicated trimming movement of the drive unit 70.

A lift cylinder 101 is pivotally attached at its lower end to a lower clevis 102. The lower clevis is, in turn, attached to a transom plate 103 which is mounted to the boat transom 71. The upper end of the lift cylinder 101 is pivotally attached to an upper clevis 104 integrally attached to the lift arm mounting bracket 90. Extension or retraction of the lift cylinder 101 will result in the raising or lowering of the lift arm 83 as it pivots about the axis of the crankshaft extension 66.

Referring particularly to FIG. 6, the lift arm 83 is disposed substantially within a recessed portion 106 in the transom 71. The transom plates 103 disposed on either side of the lift arm 83 each includes a right angle leg 105 at the transom end of the recess portion 106. The legs 105 include a series of generally vertically disposed bearing pads 107 which are adapted to absorb lateral side loads imposed by the lift arm and to guide the lift arm as it moves vertically as a result of operation of the lift cylinder.

Steering control for the drive unit 70 is provided by making the lower housing 80 and gear case 81 rotatable about the axis of the main drive shaft 78 with respect to the upper housing 74. Thus, the lower housing is pivotally attached to the upper housing via an upper pivot are 110 and a lower bearing assembly 111. Steering movement is provided by a worm gear 112 attached to a lower housing sleeve 120 driven by a worm 113 powered by a motor 114 attached to the upper housing 74.

We claim:

1. In a marine drive apparatus for a boat including an engine mounted within the boat with its crankshaft disposed transversely with respect to the centerline of the boat, a stern drive unit disposed aft of the boat transom, and a power transmission linkage comprising a sprocket-driven belt operatively connecting the engine and the drive unit, an improved system for selectively adjusting the lift and trim positions of the drive unit relative to the transom comprising:

a rigid lift arm supporting the power transmission linkage and the drive unit for generally vertical movement to a plurality of vertically spaced locations relative to the transom;

means mounting the drive unit to the lift arm for relative rotational movement therebetween;

power lift means interconnecting the boat and the lift arm for imparting the generally vertical movement;

power trim means interconnecting the boat and the drive unit for imparting the relative rotational movement while said lift arm is in any of said vertically spaced locations; and wherein the lift arm is pivotally attached to the stern of the boat for rotation about the axis of the engine crankshaft.

2. The invention as set forth in claim 1 wherein the power transmission linkage further comprises:

an axial crankshaft extension;

a drive sprocket attached to the crankshaft extension for driving the power transmission belt;

a driven shaft in the drive unit disposed to receive rotational driving movement from the power transmission belt; and a driven sprocket attached to the driven shaft for operatively connecting the power transmission belt and the driven shaft.

3. The invention as set forth in claim 2 wherein said power lift means comprises a fluid cylinder.

4. The invention as set forth in claim 3 wherein said power trim means comprises a fluid cylinder.

5. The invention as set forth in claim 4 wherein the drive unit is mounted to the lift arm for rotation about the axis of the driven shaft.

6. In a marine drive apparatus for a boat including an engine mounted within the boat, a stern drive unit disposed aft of the boat transom, and power transmission means operatively connecting the engine and the drive unit, an improved system for providing power transmission to the drive unit and for selectively adjusting the lift and trim positions of the drive unit relative to the transom comprising:

means for mounting the engine to the boat hull with the engine crankshaft disposed transversely with respect to the centerline of the hull;

an axial crankshaft extension attached to the crankshaft for rotation therewith;

a drive sprocket attached to the crankshaft extension;

a driven shaft operatively attached to the drive unit and disposed to receive rotational driving movement from the crankshaft extension, said driven shaft disposed in spaced parallel relationship to said crankshaft extension;

a driven sprocket attached to the driven shaft;

drive belt means operatively connecting the drive sprocket and the driven sprocket;

a rigid lift arm having a forward end mounted for rotation about the axis of the crankshaft extension and an aft end rotatably attached to the drive unit for relative pivotal movement about the axis of the driven shaft;

extensible trim means pivotally attached at one end to the boat and pivotally connected at the other end to the drive unit for trimming rotation of the drive unit about the axis of the driven shaft; and extensible lift means pivotally attached at one end to the boat hull and pivotally connected at the other end to the lift arm for rotating the lift arm about the axis of the crankshaft extension and moving the attached drive unit in a generally vertical direction.

7. The invention as set forth in claim 6 wherein said extensible trim and lift means each comprises a fluid operated cylinder.

8. The invention as set forth in claim 7 wherein said lift arm comprises a housing enclosing the drive belt means.

9. The invention as set forth in claim 8 wherein the trim cylinder is disposed within the housing.

10. The invention as set forth in claim 8 wherein the lift cylinder is attached at said one end to the transom and at said other end to the lift arm housing.

* * * * *